United States Patent [19]

Guillaumin

[11] 4,161,913

[45] Jul. 24, 1979

[54] RAILWAY TRUCK FRAMES

[75] Inventor: Jean-Claude Guillaumin, L'Etang la Ville, France

[73] Assignee: Societe des Acieries de Paris et d'Outreau, Paris, France

[21] Appl. No.: 784,915

[22] Filed: Apr. 5, 1977

[30] Foreign Application Priority Data

Apr. 12, 1976 [FR] France ..... 76 010660

[51] Int. Cl.[2] ..... B61F 5/00; B61F 5/04; B61F 5/14; B61F 5/52

[52] U.S. Cl. ..... 105/200; 105/202; 105/206 A; 105/208

[58] Field of Search ..... 105/202, 206 R, 200, 105/206 A, 208

[56] References Cited

U.S. PATENT DOCUMENTS

| | | | |
|---|---|---|---|
| 3,338,183 | 8/1967 | Boissier | 105/206 R X |
| 3,768,419 | 10/1973 | Howard | 105/206 R X |
| 3,915,095 | 10/1975 | Briggs | 105/202 |

*Primary Examiner*—Albert J. Makay
*Assistant Examiner*—Howard Beltran

[57] ABSTRACT

A rigid type truck or bogie frame in which the cross-member or bolster is secured at its end portions to a laterally extending central portion of each side member includes a cylindrical portion registering with the main body of the cross-member or bolster and to which the respective ends of the cross-member or bolster are secured as by by butt welding. Each central portion has an upper substantially flat face, a lower slightly convex face and two pairs of laterally protruding swells so as to reduce stress concentrations.

5 Claims, 8 Drawing Figures

RAILWAY TRUCK FRAMES

BACKGROUND OF THE INVENTION

This invention relates to improvements in the connection between a cross members or bolster and side members or side frames of railway trucks.

Recent studies proved that the areas where the longitudinal side members are connected to the cross member of a rigid-type bogie-truck as used in railway stock travelling at relatively high speed were the seat of multiple stresses, notably vertical and horizontal flexion stresses, tractive efforts and torsional stresses. In the last few years various improvements have been brought to this side-members to cross-member junction notably by changing from the construction in which the cross member was fitted into a suitable aperture formed in the side members, to the construction in which the side members and the cross member are joined by butt welding so as to cause the weld seam to emerge from the area where maximum stress concentrations are registered. This type of joining is disclosed notably in U.S. Pat. Application Ser. No. 660,131 filed Feb. 23, 1976 by the same Applicant. However, it appeared that the efficiency of this construction, notably as far as the strength and useful life of the final junction are concerned, was subordinated to a great extent to the shape of the end portion of the cross member in the junction area and that the shapes contemplated up to now did not afford a fully satisfactory stress distribution.

SUMMARY OF THE INVENTION

It is the essential object of the present invention to provide an improved configuration for the cross member end portions to be connected to the corresponding side or longitudinal members of the truck frame, with a view to reduce appreciably the areas where stress concentrations are relatively high.

Each cross member end portion rigid with the longitudinal side member, and to be welded to the main body of said cross member, is characterized essentially in that it comprises: a cylindrical portion registering with the main body of the cross member, an upper substantially flat face, a lower slightly convex face and four swells constituting two pairs of lateral swells.

BRIEF DESCRIPTION OF THE DRAWINGS

A typical and exemplary form of embodiment of this invention will now be described with reference to the attached drawings, in which.

DESCRIPTION OF THE PREFERRED EMBODIMENT

Each end portion 1 of the cross member which is to be butt-welded to the main body of this cross member is rigid with the longitudinal side member 2 and may advantageously be cast integrally therewith.

Figure 1:
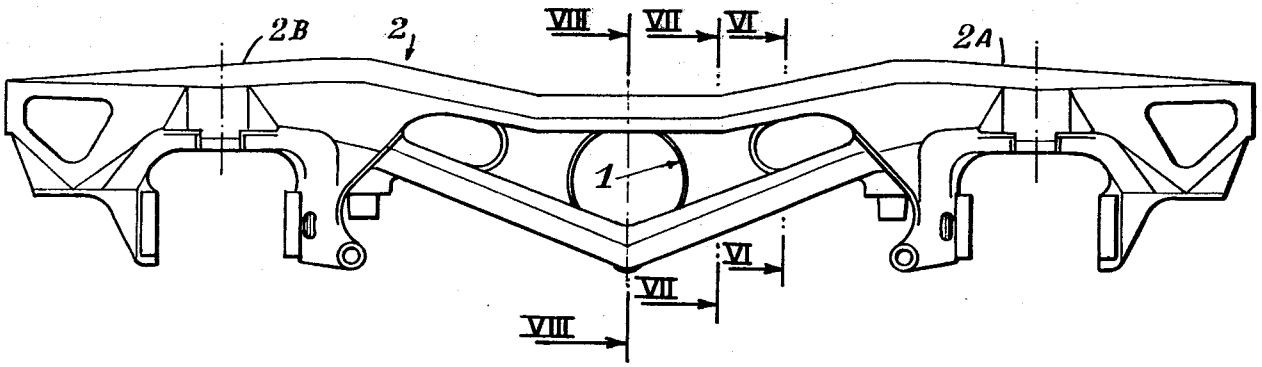
FIG. 1 is a side elevational view of a longitudinal side member of a railway rolling-stock truck provided with a cross member end portion according to this invention.
Figure 2:
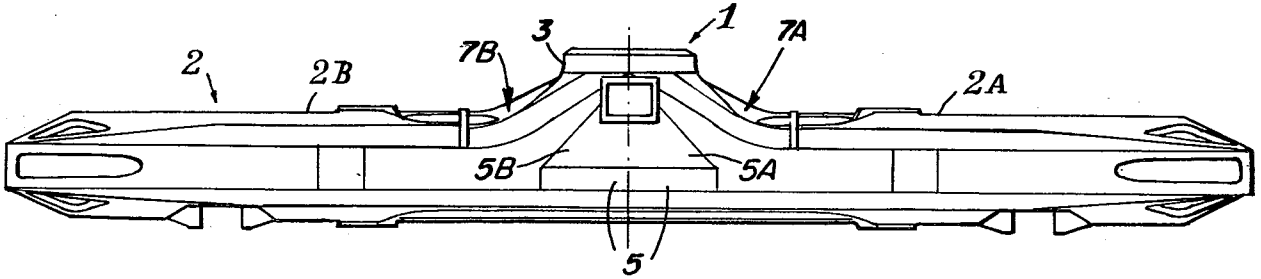
FIG. 2 is a plane view from above of this longitudinal side member.
Figure 3:
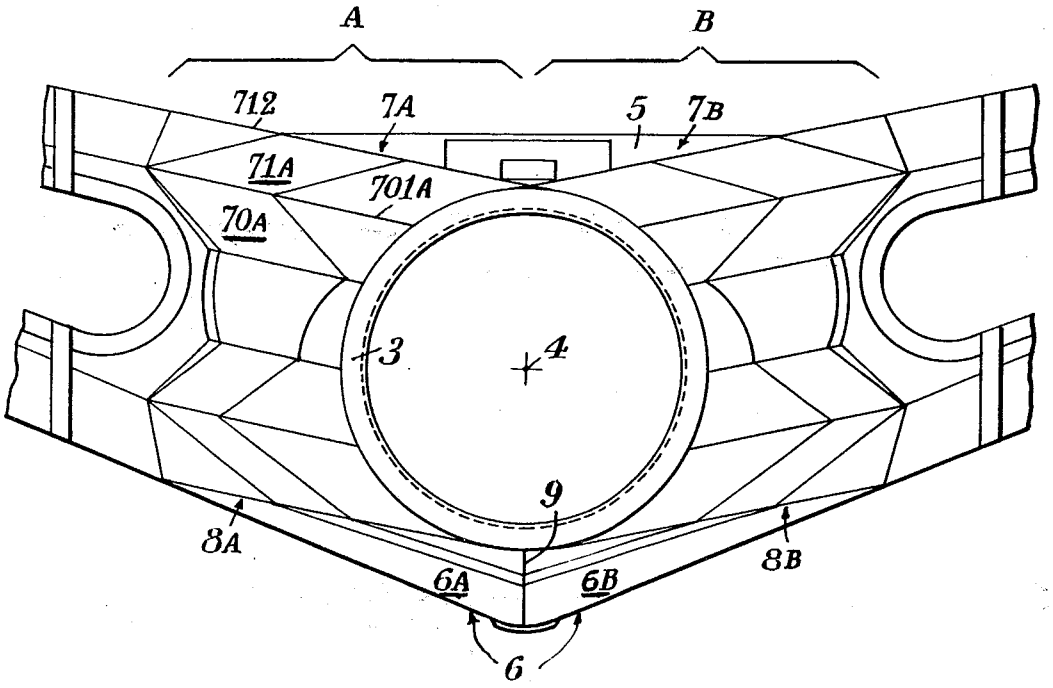
FIG. 3 is a lateral elevational view taken from inside of the central area of this side member, showing more in detail the end portion of the cross member, with level lines corresponding to the traces of two planes parallel to the surface of the drawing sheet.
Figure 4:
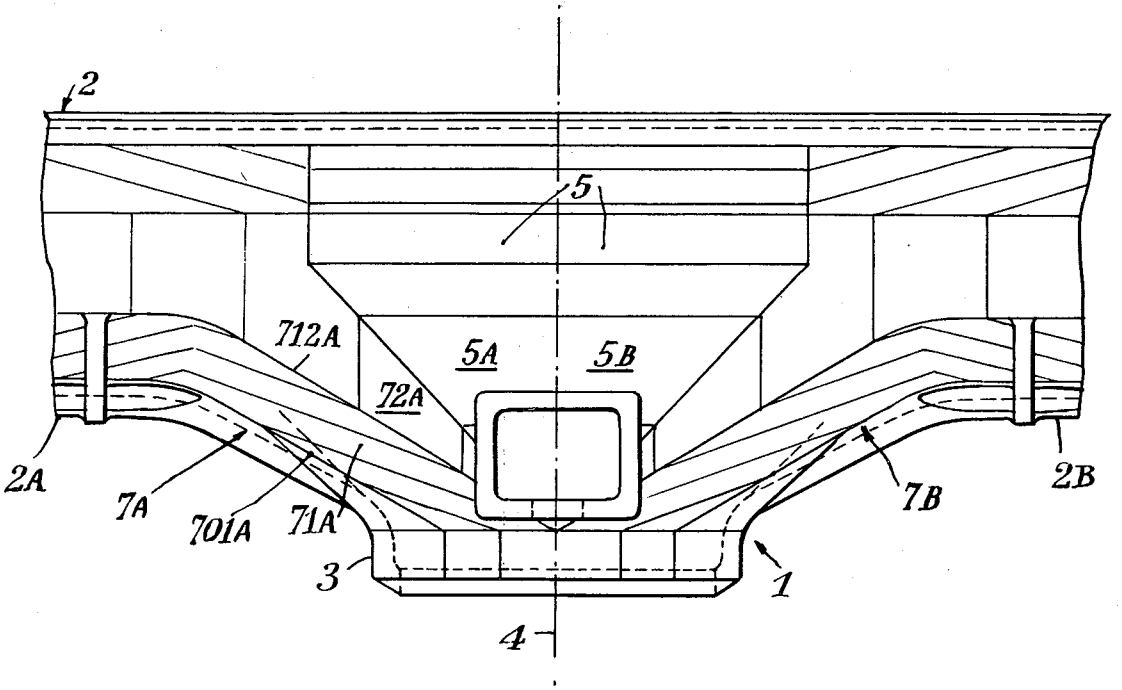
FIG. 4 is a detail of FIG. 2, shown on a larger scale end showing the cross member end portion of which other level lines are drawn and correspond to the traces of several planes parallel to the drawing sheet surface, i.e., at right angles to the two planes utilized in FIG. 3.
Figure 5:
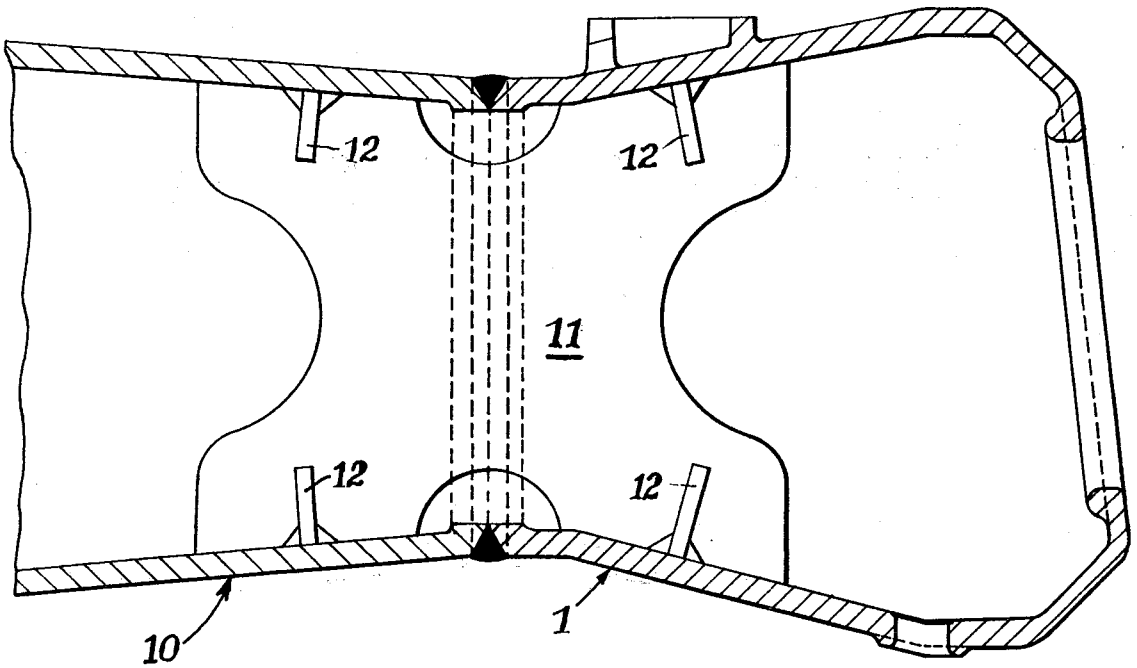
FIG. 5 is a longitudinal section showing on a larger scale the cross member and its end portion.
Figure 8:
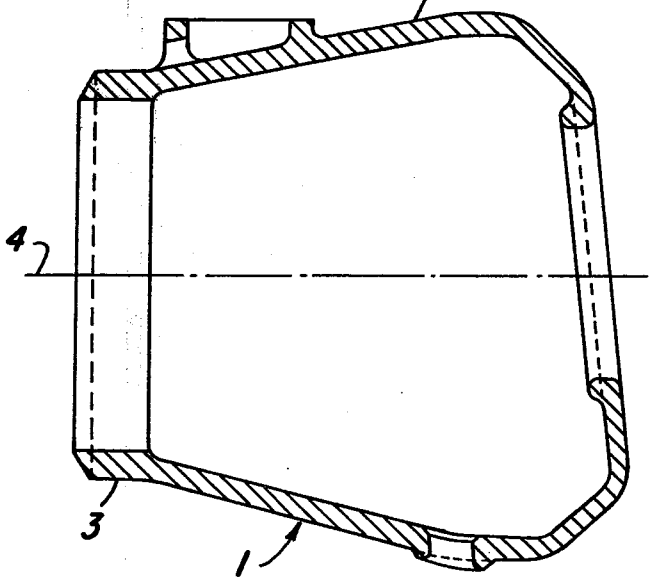
FIG. 8 is a cross-section along the line VIII—VIII in FIG. 1.
Figure 7:
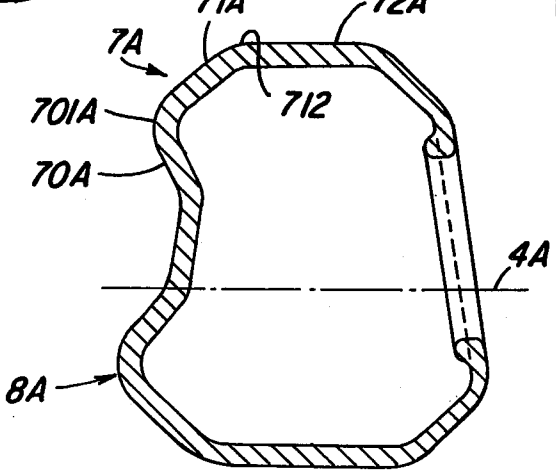
FIG. 7 is a cross-section along the line VII—VII in FIG. 1.
Figure 6:
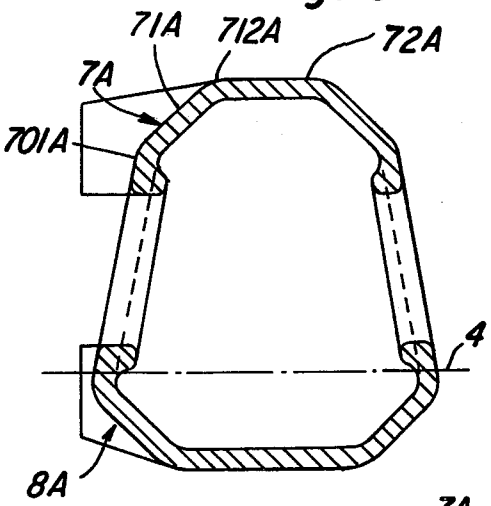
FIG. 6 is a cross-section along the line VI—VI in FIG. 1.

This end portion 1 of the cross member comprises:

a cylindrical portion 3 registering with the main body of the cross member which is also cylindrical with a circular base. The axis 4 of this cylindrical portion 3 is coincident with the axis of the cross member main body when the truck is completed.

a upper, substantially flat face 5, clearly visible in FIG. 4;

a slightly convex lower face 6 also clearly visible in FIG. 3, and four swells 7A, 8A, 7B, 8B constituting two pairs A and B of lateral swells.

The upper face or portion 5 of the end of the cross member is adapted to transmit directly the compression stresses from the top of the cross member, to the corresponding and likewise compressed upper face or portion of the longitudinal side member 2. This upper face 5 of the cross member end may advantageously begin at the cylindrical portion 3 and flare out towards the side member 2 proper, thus assuming a substantially triangular configuration.

In a preferred form of embodiment, this upper triangular face 5 is subdivided into two triangles 5A and 5B symmetrical to the vertical plane of symmetry of side member 2.

The lower, slightly convex face 6 of the cross member end assumes preferably the shape of a non-planar quadrilateral adapted to be decomposed into two equal triangles 6A and 6B by a central ridge 9 located in the vertical plane of symmetry of side member 2.

Each one of said four swells 7A, 8A, 7B, 8B departs gradually, at an angle of about 45°, from the direction of the vertical plane of symmetry of the side member 2 passing through axis 4 (see FIG. 4) of the cylindrical portion 3, and terminates at one of the corresponding arms 2A, 2B of the side member proper 2. These swells impart considerable strength to the cross-member to side member junction, i.e., through the end portion 1.

At least one of said swells, for example swell 7A, comprises a pair of dihedrons 70A, 71A and 71A, 72A having substantially parallel edges 701A, 712A and a common plane portion 71A.

Besides, the junction between the cross member or bolster 10 and its two end members 1 may be completed by means of a plate 11, welded at 12, these welds being discontinued across this junction to afford a complete inspection thereof in actual service.

Of course, the form of embodiment described hereinabove with reference to the attached drawings should not be construed as limiting the scope of the invention since various modifications may be brought thereto without departing from the basic principles of the invention as set forth in the appended claims. What is claimed as new is:

1. In a rigid type bogie-truck for railway rolling stock, comprising a pair of longitudinal side-members and a cross-member connected by butt-welding to each of said side-members in a central area thereof, a connecting appendix rigid with a respective longitudinal side-member in said central area thereof and extending laterally therefrom, said connecting appendix comprising:

a cylindrical portion forming the shape of a connection between the appendix and the cross-member, an upper substantially flat face, a lower slightly convex face, said upper and said lower faces extending from said cylindrical portion and flaring out towards the respective longitudinal side-member, and four swells constituting two pairs of lateral swells, each one of said swells extending and gradually departing from said cylindrical portion towards a respective arm of the respective side-member.

2. A connecting appendix as recited in claim 1, wherein said lower, slightly convex face has a quadrilateral configuration, with at least two portions thereof lying in different planes.

3. A connecting appendix as recited in claim 2, wherein said lower face is adapted to be subdivided into two equal triangles by means of a ridge located in a vertical plane of symmetry of the respective longitudinal side-member.

4. A connecting appendix as recited in claim 1, wherein at least one of said swells consist of a pair of dihedrons having substantially parallel edges and a common plane portion.

5. A connecting appendix as recited in claim 1, which is cast integrally with the respective longitudinal side-member.

* * * * *